US012312884B2

(12) United States Patent
Skibsrud et al.

(10) Patent No.: US 12,312,884 B2
(45) Date of Patent: May 27, 2025

(54) AUTOMATED FINGERBOARD FOR A DRILLING RIG

(71) Applicant: Schlumberger Technology Corporation, Sugar Land, TX (US)

(72) Inventors: Rune Skibsrud, Bygland (NO); Kristian Tindvik, Kristiansand (NO); Dag Holen, Kristiansand (NO); Ivar Magnus Jansen, Søgne (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 132 days.

(21) Appl. No.: 18/249,623

(22) PCT Filed: Oct. 20, 2021

(86) PCT No.: PCT/US2021/071932
§ 371 (c)(1),
(2) Date: Apr. 19, 2023

(87) PCT Pub. No.: WO2022/087590
PCT Pub. Date: Apr. 28, 2022

(65) Prior Publication Data

US 2024/0003204 A1 Jan. 4, 2024

Related U.S. Application Data

(60) Provisional application No. 63/094,727, filed on Oct. 21, 2020.

(51) Int. Cl.

| | |
|---|---|
| ***E21B 19/20*** | (2006.01) |
| ***E21B 19/14*** | (2006.01) |
| ***E21B 19/24*** | (2006.01) |

(52) U.S. Cl.
CPC ..... *E21B 19/20* (2013.01); *E21B 19/14* (2013.01); *E21B 19/24* (2013.01)

(58) Field of Classification Search
CPC ..... E21B 19/15; E21B 19/155; E21B 19/20
See application file for complete search history.

(56) References Cited

U.S. PATENT DOCUMENTS 9,016,382 B2 * 4/2015 Braxton ..... E21B 19/14 166/360
2005/0236157 A1 * 10/2005 Logan ..... E21B 19/143 166/85.1

(Continued)

FOREIGN PATENT DOCUMENTS

| | | |
|---|---|---|
| CN | 204476297 U | 7/2015 |
| CN | 204552646 U | 8/2015 |
| CN | 110566132 A | 12/2019 |

OTHER PUBLICATIONS

International Preliminary Report on Patentability of International Patent Application No. PCT/US2021/071932 dated May 4, 2023, 8 pages.

(Continued)

*Primary Examiner* — Yanick A Akaragwe
(74) *Attorney, Agent, or Firm* — Jeffrey D. Frantz

(57) ABSTRACT

A fingerboard includes a first finger and a second finger that are laterally offset from one another. A slot is defined between the first and second fingers. The fingerboard also includes a latch coupled to the first finger and configured to actuate from an open latch position into a closed latch position, and a panel coupled to the first finger and configured to actuate from an open panel position into a closed panel position. A tubular member in the slot prevents the panel from actuating into the closed panel position. The latch in the open latch position prevents the panel from actuating into the closed panel position. The panel in the (Continued)

closed panel position extends laterally between the first finger and the second finger so as to provide a surface across the slot.

19 Claims, 6 Drawing Sheets

(56) References Cited

U.S. PATENT DOCUMENTS

| | | | | |
|---|---|---|---|---|
| 2015/0048038 | A1* | 2/2015 | Roodenburg | E21B 19/14 211/70.4 |
| 2017/0260818 | A1* | 9/2017 | Berry | E21B 19/14 |
| 2019/0153791 | A1* | 5/2019 | Slettedal | E21B 19/14 |
| 2020/0080390 | A1* | 3/2020 | Gullaksen | E21B 19/155 |

OTHER PUBLICATIONS

Search Report and Written Opinion of International Patent Application No. PCT/US2021/071932 dated Feb. 4, 2022; 11 pages.

* cited by examiner

AUTOMATED FINGERBOARD FOR A DRILLING RIG

CROSS-REFERENCE TO RELATED APPLICATIONS

This application is the National Stage Entry of International Application No. PCT/US2021/071932, filed Oct. 20, 2021, which claims priority to U.S. Provisional Patent Application No. 63/094,727, filed on Oct. 21, 2020, the entirety of which is incorporated by reference herein.

BACKGROUND

A fingerboard is a working platform used for pipe storage in a drilling rig. The fingerboard is generally positioned approximately halfway up a derrick or mast of the drilling rig, and includes horizontal metal fingers separated by slots. As a tubular (e.g., a drill pipe, a drill collar, a stand, etc.) is tripped out of a wellbore, for example, an automatic pipe handling system may slide the top of the tubular horizontally in one of the slots. Similarly, as tubulars are tripped into the wellbore, the automatic pipe handling system may move the tubulars out of the slots. The fingerboard also includes latches which secure the tubulars in place in the slots while stored. The automatic pipe handling system may sometimes be offline, and a person (e.g., a derrickman) may continue racking and unracking the tubulars manually. However, the latches may make it difficult for the derrickman to move over the fingerboard to perform manual racking operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments of the disclosure include a fingerboard that includes a first finger and a second finger that are laterally offset from one another. A slot is defined between the first and second fingers. The fingerboard also includes a latch coupled to the first finger and configured to actuate from an open latch position into a closed latch position, and a panel coupled to the first finger and configured to actuate from an open panel position into a closed panel position. A tubular member in the slot prevents the panel from actuating into the closed panel position. The latch in the open latch position prevents the panel from actuating into the closed panel position. The panel in the closed panel position extends laterally between the first finger and the second finger so as to provide a surface across the slot.

Embodiments of the disclosure also include a fingerboard for storing tubular members on a drilling rig includes a plurality of fingers that are laterally offset from one another. A slot is defined between a first finger of the fingers and a second finger of the fingers. The fingerboard also includes a plurality of latches coupled to the plurality of fingers. The plurality of latches includes a first latch coupled to the first finger, the first latch is configured to actuate from an open latch position into a closed latch position, the first latch in the open latch position is configured to permit a tubular member to move therepast within the slot, and the first latch in the closed latch position is configured to restrain the tubular member in a predetermined position within the slot. The fingerboard also includes a plurality of panels including a first panel coupled to the first finger. The first panel is configured to actuate from an open panel position into a closed panel position. The first latch in the open latch position and the first panel in the open panel position allow the tubular member to move therepast within the slot. The first latch in the open latch position prevents the first panel from actuating into the closed panel position, the first panel is in the open panel position as the first latch actuates into the closed latch position, the first panel is configured to actuate into the closed panel position in response to no tubular members being positioned within the slot and the first latch being in the closed latch position, the first panel in the closed panel position is positioned above the first latch in the closed latch position, and the first panel in the closed panel position extends laterally between the first finger and the second finger so as to provide a surface across the slot for a person to walk on.

Embodiments of the disclosure further include a method for operating a fingerboard on a drilling rig. The method includes actuating a latch from an open latch position into a closed latch position, the latch being coupled to a first finger of the fingerboard, actuating a panel from an open panel position into a closed panel position after the latch is actuated into the closed latch position, wherein the panel is coupled to the first finger. The panel in the closed panel position is positioned above the latch in the closed latch position, and the panel in the closed panel position extends laterally between the first finger and a second finger.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
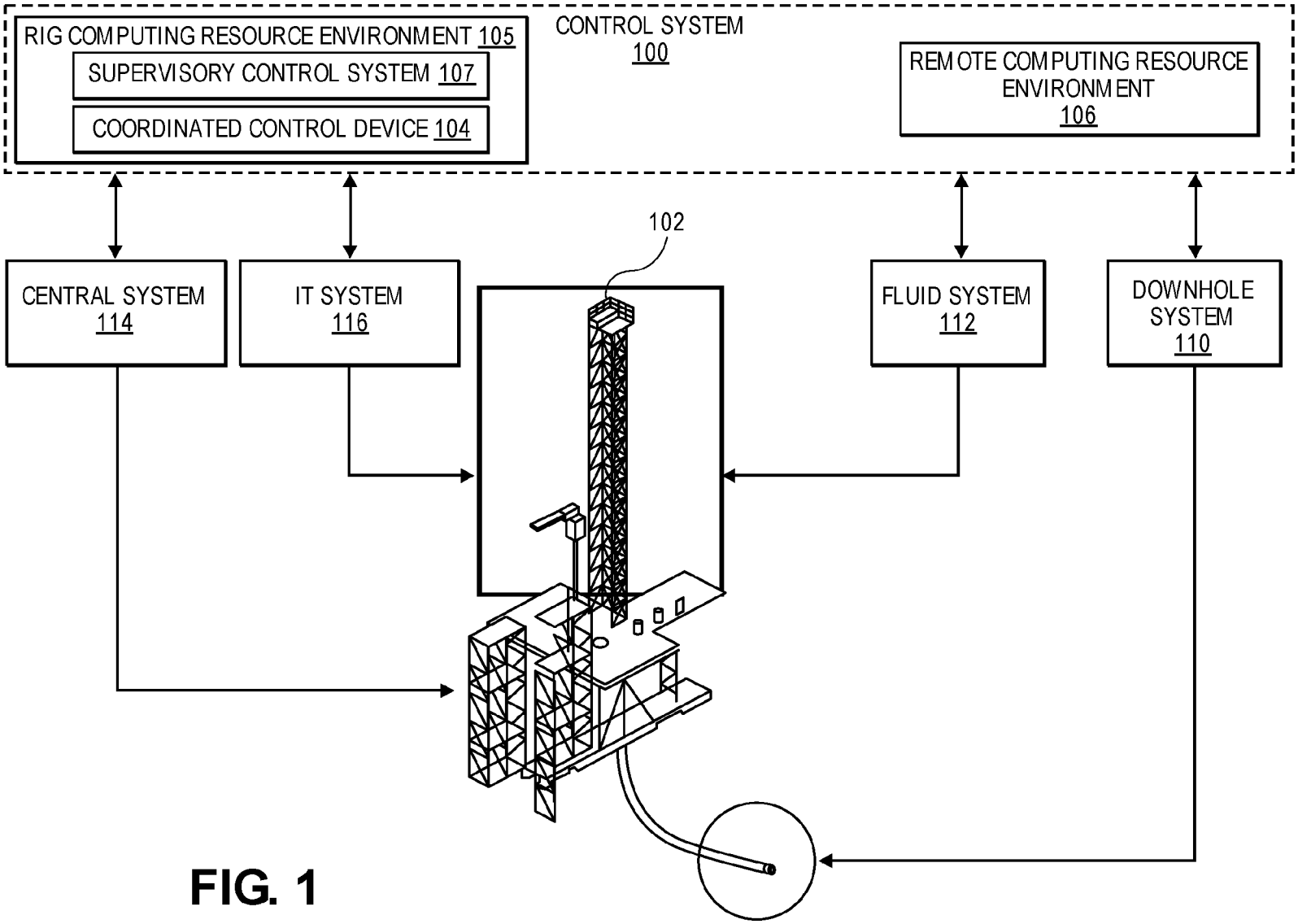
FIG. 1 illustrates a conceptual, schematic view of a control system for a drilling rig, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottom-hole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
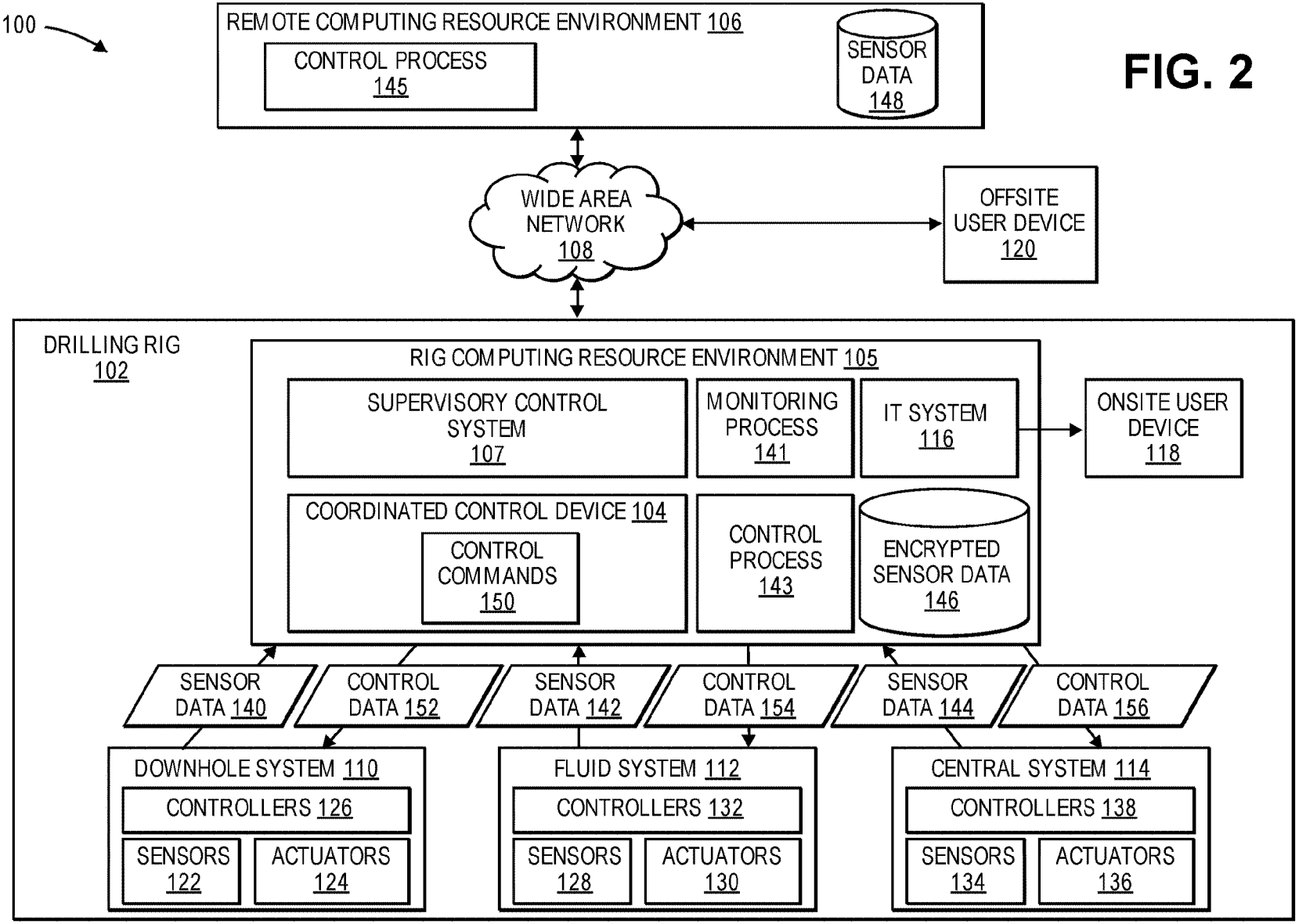
FIG. 2 illustrates a conceptual, schematic view of the control system, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Automated Fingerboard for a Drilling Rig

Figure 3:
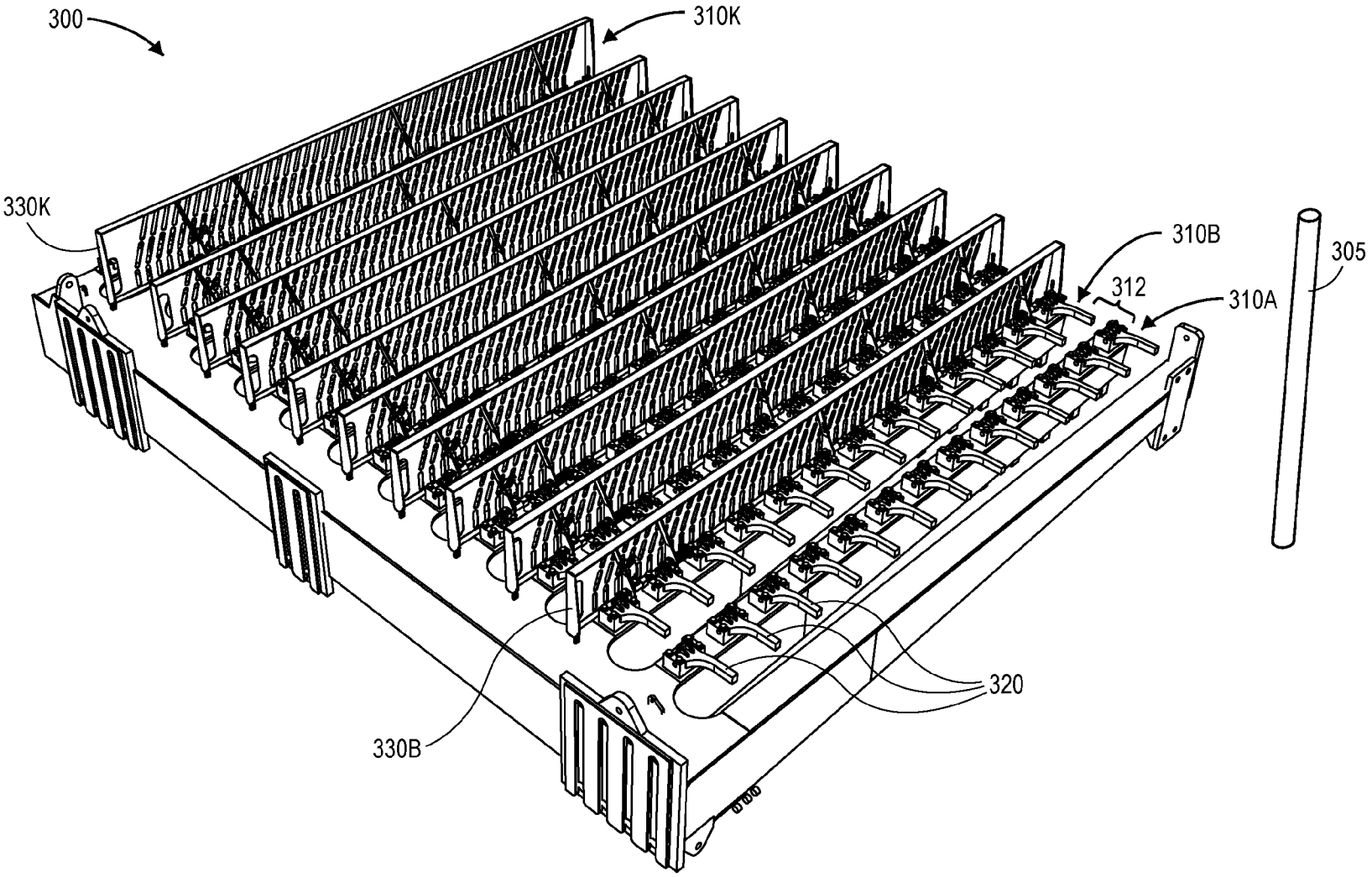
FIG. 3 illustrates a perspective view of a fingerboard on the drilling rig with a plurality of panels in a first (e.g., open) panel position, according to an embodiment.

FIG. 3 illustrates a perspective view of a fingerboard 300 on the drilling rig 102 for storing a plurality of tubular members 305, according to an embodiment. The tubular members 305 may be or include one or more segments of drill pipe, drill collar, liner, casing, or a combination thereof. For example, the tubular members 305 may be or include a stand of two or three segments that are coupled together.

The fingerboard 300 may include a plurality of fingers 310A-310K. The fingers 310A-310K may be substantially horizontal with respect to the ground and/or the rig floor. The fingers 310A-310K may be substantially parallel to and substantially laterally offset from one another. As a result, a slot 312 may be defined lengthwise between each two adjacent fingers (e.g., fingers 310A, 310B).

The fingerboard 300 may also include a plurality of latches 320. More particularly, each finger 310A-310K may have a plurality of latches 320 coupled thereto. The latches 320 may be axially offset from one another (i.e., along the length of the individual fingers 310A-310K). The latches 320 may be configured to actuate from a first (e.g., open) latch position to a second (e.g., closed) latch position. When in the open latch position, the latches 320 may extend substantially vertically (e.g., upward), which permits one or more tubular members 305 to slide therepast within the slot 312. For example, a tubular member 305 that has been tripped out of a wellbore may slide through the slot 312 and past one or more of the open latches 320 to a predetermined position within the slot 312.

The latches 320 may be configured to actuate independently from one another from the open latch position into the closed latch position by rotating about 90 degrees around a shaft and/or one or more hinges. When in the closed latch position (as shown in FIG. 3), the latches 320 may extend substantially horizontally at least partially across the slot 312 to prevent the tubular member 305 from sliding therepast. For example, when the tubular member 305 is in the predetermined position in the slot 312, one of the latches 320 may actuate into the closed latch position to secure the tubular member 305 in the predetermined position.

The fingerboard 300 may also include a plurality of panels 330B-330K. More particularly, each finger 310A-310K may have a panel 330B-330K coupled thereto. The panel for the finger 310A has been omitted in FIG. 3 for clarity. For example, the finger 310B may have a panel 330B coupled thereto. The panel 330B may be configured to actuate from a first (e.g., open) panel position to a second (e.g., closed) panel position. When in the open panel position, the panel 330B may extend substantially vertically (e.g., upward). When in the closed panel position, the panel 330B may extend substantially horizontally. Thus, when the panel 330B actuates between the open and closed panel positions, the panel 330B may rotate around about 90 degrees through an arcuate path and provide a surface across the slot 312 between the fingers 310A, 310B.

One or more of the tubular members 305 may be configured to move within the slot 312 when the latches 320 are in the open latch position and the panel 330B is in the open panel position. As mentioned above, the latches 320 may be configured to actuate into the closed latch position to secure the tubular member 305 in place within the slot 312. The panel 330B may be in the open panel position when the latches 320 actuate into the closed latch position to secure the tubular member in place within the slot 312.

Figure 4:
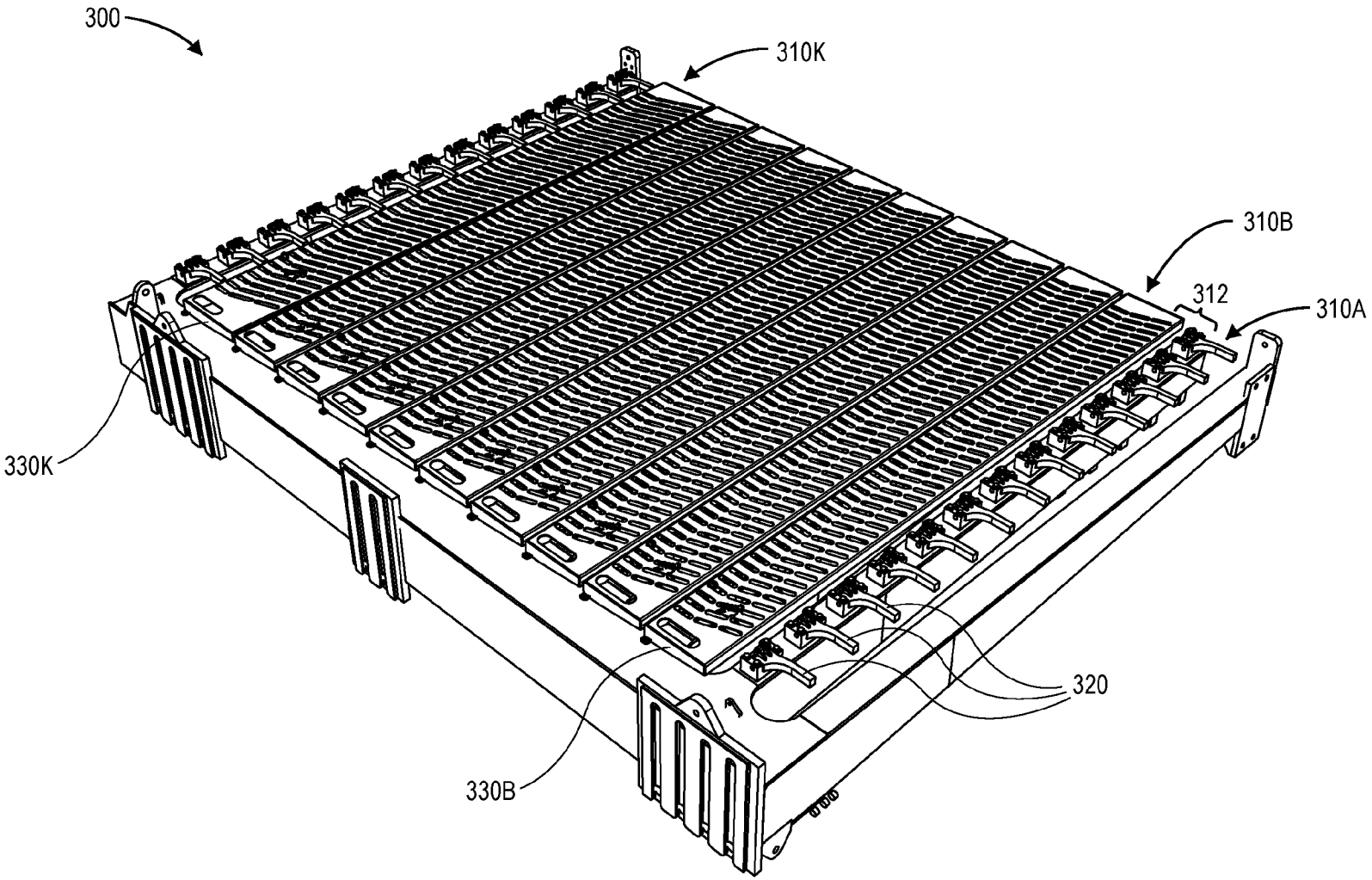
FIG. 4 illustrates a perspective view of the fingerboard with the panels in a second (e.g., closed) panel position, according to an embodiment.

FIG. 4 illustrates a perspective view of the fingerboard 300 with the panels 330B-330K in the closed panel position, according to an embodiment. The panel 330B may be configured to actuate into the closed panel position when no tubular members 305 are within the slot 312 between the fingers 310A, 310B, and the latches 320 are in the closed latch position. The panel 330B may be positioned above the latches 320 when the panel 330B is in the closed panel position, and the latches 320 are in the closed latch position. The panel 330B may provide a surface on which a person (e.g., derrickman) may walk when the panel 330B is in the closed panel position. As described in greater detail below, having the panel 330B function as a surface on which the derrickman may walk may help the derrickman to safely and efficiently manually move the tubular members 305 into and/or out of the fingerboard 300. For example, the panel 330B may eliminate the risk of tripping and falling over the latches that are below the panel 330B.

Figure 5:
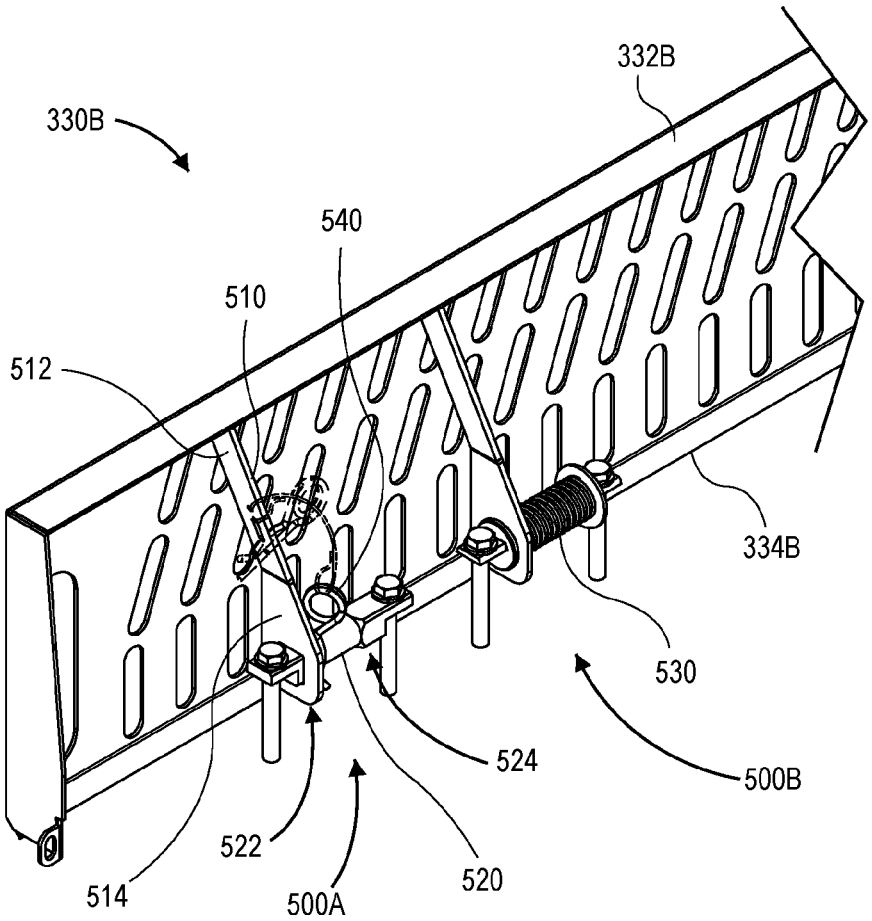
FIG. 5 illustrates a perspective view of one of the panels from the fingerboard in the open panel position, according to an embodiment.

FIG. 5 illustrates a perspective view of the panel 330B in the open panel position, according to an embodiment. One or more actuation mechanisms 500A, 500B may be coupled to the finger 310B and/or the panel 330B. The actuation mechanisms 500A, 500B may be positioned adjacent to an underside of the panel 330B. As a result, the actuation mechanisms 500A, 500B may be positioned below the panel 330B when the panel 330B is in the closed panel position.

The actuation mechanisms 500A, 500B may be configured to actuate the panel 330B between the open and closed panel positions. The actuation mechanism 500A is described below, and it will be appreciated that the other actuation mechanisms (e.g., actuation mechanism 500B) may be the same as, or different from, the actuation mechanism 500A.

The actuation mechanism 500A may include an arm 510 having a first arm end 512 and a second arm end 514. The first arm end 512 may be coupled to a first side 332B of the panel 330B. The actuation mechanism 500A may also include a shaft 520. The shaft 520 may be substantially horizontal. The shaft 520 may be positioned adjacent to a second side 334B of the panel 332B. The shaft 520 may be coupled to the finger 310B and/or the second arm end 514.

The panel 330B may be secured in the open panel position when the arm 510 is in a first arm position 522 along the shaft 520. For example, an inner surface of the second arm end 514 may have a shape (e.g., square), and an outer surface of the shaft 520 may have a first shape (e.g., square) at the first arm position 522. The square shaft 520 may not be able to rotate within the square arm 510, which may secure the panel 330B in the open panel position and/or the closed panel position. In other words, the panel 330B may be prevented from actuating between the open and closed panel positions.

The panel 330B may be configured to actuate between the open and closed panel positions when the arm 510 is in a second arm position 524 along the shaft 520. The first and second arm positions 522, 524 may be axially offset from one another along the shaft 520. In FIG. 5, the second arm position 524 is to the right of the first arm position 522. Continuing with the example above, the outer surface of the shaft 520 may have a second shape (e.g., round) at the second arm position 524. The round shaft 520 may be able to rotate within the square arm 510, which may allow the panel 330B to actuate between the open and closed panel positions.

The actuation mechanism 500A may also include a biasing member 530. The biasing member 530 has been omitted from the actuation mechanism 500A to show the profile of the shaft 520 underneath; however, the biasing member 530 may be seen on the actuation mechanism 500B. The biasing member 530 may be or include a spring that is configured to axially extend and/or contract. The biasing member 530 may be positioned at least partially around the shaft 520.

The biasing member 530 may be configured to exert an axial force on the panel 330B, the arm 510, or both in a first axial direction (e.g., to the left in FIG. 5). More particularly, the biasing member 530 may push the second arm end 514 into the first arm position 522, which may secure the panel 330B in the open panel position and/or the closed panel position. In other words, the panel 330B may be prevented from actuating between the open and closed panel positions.

The axial force exerted by the biasing member 530 may be overcome by an axial force in a second axial direction (e.g., to the right in FIG. 5). This opposing axial force may be exerted automatically by automated equipment or by the derrickman. More particularly, the opposing axial force may push the second arm end 514 into the second arm position 524, which may allow the panel 330B to actuate between the open panel position and the closed panel position.

The actuation mechanism 500A may also include a pin 540 that may be used to secure (i.e., lock) the second arm end 514 in the first arm position 522 and thereby secure the panel 330B in the open panel position and/or the closed panel position. The pin 540 may be configured to extend at least partially through the shaft 520 when securing the second arm end 514 in the first arm position 522. The pin 540 may be stored within a hole in the arm 510 when the second arm end 514 is not being secured in the first arm position 522. This may allow the second arm end 514 to actuate between the first and second arm positions 522, 524, which may allow the panel 330A to actuate between the open and closed panel positions.

Figure 6:
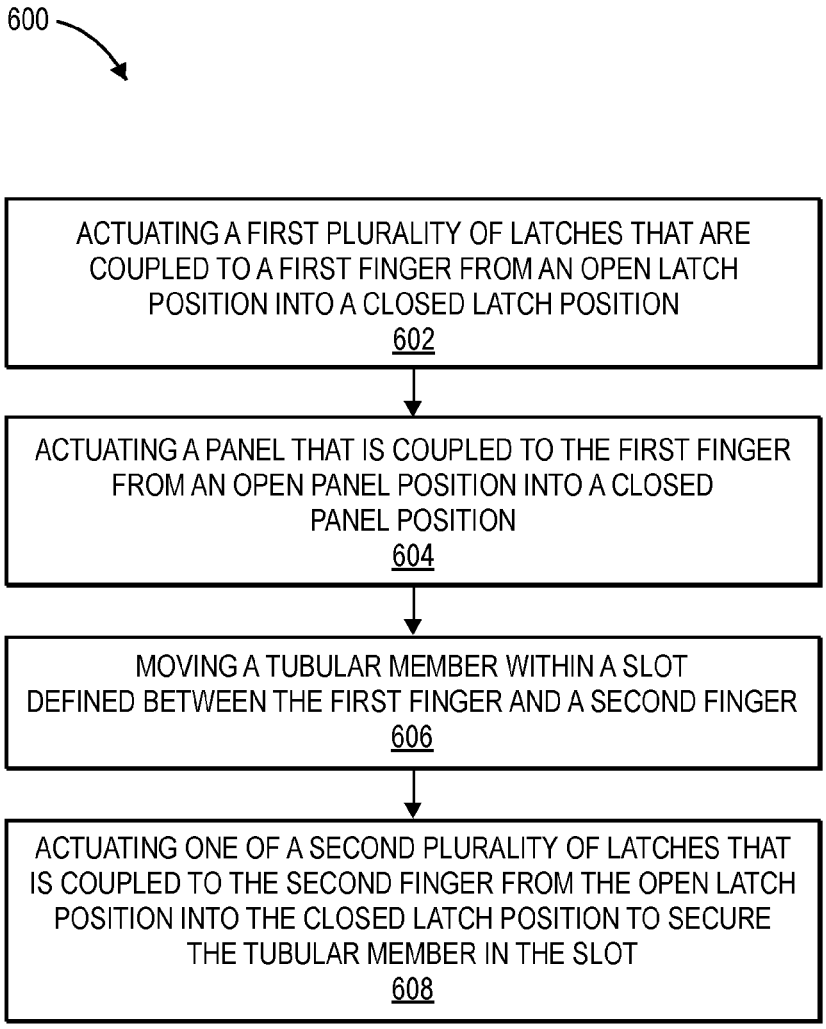
FIG. 6 illustrates a flowchart of a method for operating the fingerboard, according to an embodiment.

FIG. 6 illustrates a flowchart of a method 600 for operating the fingerboard 300, according to an embodiment. An illustrative order of the method 600 is provided below; however, one or more aspects of the method 600 may be performed in a different order, combined, split into sub-steps, repeated, or omitted. One or more of the aspects of the method 600 may be performed manually (e.g., by the derrickman). One or more aspects of the method 600 may also or instead be performed by automated equipment on the drilling rig 102.

The method 600 may include actuating a first plurality of latches 320 from the open latch position into the closed latch position, as at 602. The first plurality of latches 320 may be coupled to one of the fingers (e.g., the finger 310B).

The method 600 may also include actuating the panel 330B from the open panel position into the closed panel position, as at 604. Examples of this are described above with reference to FIG. 5.

The method 600 may also include moving one of the tubular members 305 within a slot 312, as at 606. The latches 320 coupled to the finger 310A may be in the open latch position, and the panel coupled to the finger 310A may be in the open panel position. The derrickman may stand on the panel 310B as the derrickman manually helps move the tubular member 305 into or out of the slot 312.

The method 600 may also include actuating one of a second plurality of latches 320 from the open latch position into the closed latch position, as at 608. The second plurality of latches 320 may be coupled to one of the fingers (e.g., the finger 310A). The actuated latch 320 may secure the tubular member 305 in a predetermined position in the slot 312 when in the closed latch position. The derrickman may stand on the panel 310B as the derrickman manually helps actuate the latch 320. The method 600 may then loop back to 606 to rack additional tubular members 305.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A fingerboard, comprising:

a first finger and a second finger that are laterally offset from one another, wherein a slot is defined between the first and second fingers;

a latch coupled to the first finger, wherein the latch is configured to actuate from an open latch position into a closed latch position; and a panel coupled to the first finger, wherein the panel is configured to actuate from an open panel position into a closed panel position, wherein a tubular member in the slot prevents the panel from actuating into the closed panel position, wherein the latch in the open latch position prevents the panel from actuating into the closed panel position, and wherein the panel in the closed panel position extends laterally between the first finger and the second finger so as to provide a surface across the slot.

2. The fingerboard of claim 1, wherein the latch in the open latch position permits the tubular member to move therepast in the slot, and wherein the latch in the closed latch position is configured to secure the tubular member in a predetermined position within the slot.

3. The fingerboard of claim 1, wherein the panel in the open panel position is configured to permit the tubular member to move therepast in the slot.

4. The fingerboard of claim 1, wherein the latch actuates into the closed latch position independent of the panel actuating.

5. The fingerboard of claim 1, wherein the panel is configured to actuate into the closed panel position after the latch is in the closed latch position.

6. The fingerboard of claim 1, wherein the panel in the closed panel position is positioned above the latch in the closed latch position.

7. The fingerboard of claim 1, wherein the latch and the panel are configured to actuate independently from one another.

8. The fingerboard of claim 1, further comprising an actuation mechanism coupled to the first finger and the panel, wherein the actuation mechanism is configured to actuate the panel between the open panel position and the closed panel position.

9. The fingerboard of claim 8, wherein the actuation mechanism comprises:

an arm having a first arm end and a second arm end, wherein the first arm end is coupled to the panel; and a horizontal shaft coupled to the second arm end and the first finger, wherein the panel is secured in the open panel position or the closed panel position in response to the arm being in a first arm position along the shaft.

10. The fingerboard of claim 9, wherein the panel is configured to actuate between the open and closed panel positions in response to the arm moving into a second arm position along the shaft, and wherein the first and second arm positions are axially offset from one another along the shaft.

11. A fingerboard for storing tubular members on a drilling rig, the fingerboard comprising:

a plurality of fingers that are laterally offset from one another, wherein a slot is defined between a first finger of the plurality of fingers and a second finger of the plurality of fingers;

a plurality of latches coupled to the plurality of fingers, wherein the plurality of latches comprises a first latch coupled to the first finger, wherein the first latch is configured to actuate from an open latch position into a closed latch position, wherein the first latch in the open latch position is configured to permit a tubular member to move therepast within the slot, and wherein the first latch in the closed latch position is configured to restrain the tubular member in a predetermined position within the slot; and a plurality of panels comprising a first panel coupled to the first finger, wherein the first panel is configured to actuate from an open panel position into a closed panel position, wherein the first latch in the open latch position and the first panel in the open panel position allow the tubular member to move therepast within the slot, wherein the first latch in the open latch position prevents the first panel from actuating into the closed panel position, wherein the first panel is in the open panel position as the first latch actuates into the closed latch position, wherein the first panel is configured to actuate into the closed panel position in response to no tubular members being positioned within the slot and the first latch being in the closed latch position, wherein the first panel in the closed panel position is positioned above the first latch in the closed latch position, and wherein the first panel in the closed panel position extends laterally between the first finger and the second finger so as to provide a surface across the slot for a person to walk on.

12. The fingerboard of claim 11, further comprising a plurality of actuation mechanisms, wherein the plurality of actuation mechanisms comprises a first actuation mechanism coupled to the first finger and the first panel, wherein the first actuation mechanism is configured to actuate the first panel between the open panel position and the closed panel position, and wherein the first actuation mechanism is positioned below the first panel in the closed panel position.

13. The fingerboard of claim 12, wherein the first actuation mechanism comprises:

an arm having a first arm end and a second arm end, wherein the first arm end is coupled to the first panel; and a horizontal shaft coupled to the second arm end and the first finger, wherein the first panel is secured in the open panel position or the closed panel position in response to the arm being in a first arm position along the shaft.

14. The fingerboard of claim 13, wherein the first panel is configured to actuate between the open and closed panel positions in response to the arm moving into a second arm position along the shaft, and wherein the first and second arm positions are axially offset from one another along the shaft.

15. The fingerboard of claim 14, wherein the first actuation mechanism further comprises a biasing member configured to exert an axial force on the first panel, the arm, or both in a first axial direction to bias the arm toward the first arm position.

16. A method for operating a fingerboard on a drilling rig, the method comprising:

actuating a latch from an open latch position into a closed latch position, wherein the latch is coupled to a first finger of the fingerboard; and actuating a panel from an open panel position into a closed panel position after the latch is actuated into the closed latch position, wherein the panel is coupled to the first finger, wherein the panel in the closed panel position is positioned above the latch in the closed latch position, and wherein the panel in the closed panel position extends laterally between the first finger and a second finger, wherein actuating the panel comprises exerting an axial force on the panel, which causes an arm of an actuation mechanism to move along a shaft of the actuation mechanism from a first shaft position to a second shaft position, and wherein exerting the axial force comprises overcoming an opposing axial force that is exerted by a biasing member of the actuation mechanism.

17. The method of claim 16, further comprising:

actuating the latch from the closed latch position into the open latch position; and removing a tubular member from a slot defined between the first finger and a second finger of the fingerboard after the latch has been actuated into the open latch position, wherein the latch is actuated from the open latch position into the closed latch position after the tubular member has been removed from the slot.

18. The method of claim 16, wherein the panel is prevented from actuating from the open panel position to the closed panel position, and from the closed panel position to the open panel position, in response to the arm being located at the first shaft position.

19. The method of claim 18, further comprising inserting a pin into the shaft to prevent the arm from moving along the shaft from the first shaft position to the second shaft position, thereby securing the panel in the closed panel position.

* * * * *